US010065720B2

(12) United States Patent
Sylvia et al.

(10) Patent No.: US 10,065,720 B2
(45) Date of Patent: Sep. 4, 2018

(54) SUBMARINE PRESSURE VESSEL LAUNCH CANISTER

(71) Applicant: LOCKHEED MARTIN CORPORATION, Bethesda, MD (US)

(72) Inventors: Russell M. Sylvia, South Dartmouth, MA (US); Martin C. Lewis, Plymouth, MA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 15/133,749

(22) Filed: Apr. 20, 2016

(65) Prior Publication Data

US 2017/0183069 A1 Jun. 29, 2017

Related U.S. Application Data

(60) Provisional application No. 62/149,900, filed on Apr. 20, 2015.

(51) Int. Cl.

| | |
|---|---|
| ***B63G 8/00*** | (2006.01) |
| ***B63G 8/32*** | (2006.01) |
| ***B63G 8/08*** | (2006.01) |
| ***B63G 8/20*** | (2006.01) |
| ***F41F 3/10*** | (2006.01) |

(52) U.S. Cl.

CPC ..... *B63G 8/32* (2013.01); *B63G 8/001* (2013.01); *B63G 8/08* (2013.01); *B63G 8/20* (2013.01); *F41F 3/10* (2013.01); *B63B 2755/00* (2013.01); *B63G 2008/002* (2013.01)

(58) Field of Classification Search

CPC .... H01M 10/34; H01M 2200/00; B63G 8/32; B63G 8/001; B63G 8/08; B63G 8/20

See application file for complete search history.

(56) References Cited

U.S. PATENT DOCUMENTS 4,992,999 A 2/1991 Yerby et al.
5,487,350 A 1/1996 Chace, Jr. et al.
(Continued)

FOREIGN PATENT DOCUMENTS

WO 2014039690 3/2014

OTHER PUBLICATIONS

International Search Report and Written Opinion for application No. PCT/US2016/028387, dated Jul. 28, 2016 (15 pages).
(Continued)

*Primary Examiner* — Stephen P Avila
(74) *Attorney, Agent, or Firm* — Hamre, Schumann, Mueller & Larson, P.C.

(57) ABSTRACT

A canister that acts as a pressure vessel that contains a payload and that can withstand pressures that may be generated by the payload internal to the canister in order to contain the payload contents. The canister can be launched from a submarine, with the canister being located internal to the pressure hull of the submarine prior to launch and the canister being launchable from the submarine into the surrounding water. After launching, the canister is designed to release or deploy the payload permitting the payload to perform its intended function(s). The payload contained in the canister can be an unmanned underwater vehicle such as an acoustic training target that is powered by one or more lithium batteries.

16 Claims, 14 Drawing Sheets

(56) References Cited

U.S. PATENT DOCUMENTS

| | | | | |
|---|---|---|---|---|
| 5,490,473 | A | 2/1996 | Chace, Jr. et al. | |
| 5,537,947 | A | 7/1996 | Couture et al. | |
| 5,600,087 | A | 2/1997 | Chace, Jr. | |
| 5,666,900 | A | 9/1997 | Carroll, III et al. | |
| 8,171,873 | B2 | 5/2012 | Woolwright et al. | |
| 8,936,125 | B2 | 1/2015 | Nakamori | |
| 2011/0083600 | A1 | 4/2011 | Whitten et al. | |
| 2011/0220001 | A1 | 9/2011 | Bossert et al. | |
| 2012/0205488 | A1 | 8/2012 | Powell et al. | |
| 2014/0224167 | A1* | 8/2014 | Gasparoni ..... | B63C 11/52 114/321 |

OTHER PUBLICATIONS

"MK39 Expendable Mobile ASW Training Target and Field Programmability System (EMATT): A Small, Dynamic Submarine-Like Target," Lockheed Martin Corporation, 2013 (2 pages).
"SUBMATT: Submarine Mobile Acoustic Training Target and Field Programmability System," Lockheed Martin Corporation, 2010 (2 pages).

* cited by examiner

SUBMARINE PRESSURE VESSEL LAUNCH CANISTER

FIELD

This disclosure relates to a canister that acts as a pressure vessel that can contain a payload, such as an underwater vehicle, and which can be launched underwater, for example from a submarine or other subsurface vessel.

BACKGROUND

Acoustic training targets (ATT) are used for anti-submarine (ASW) training. One example of an ATT is the MK39 Expendable Mobile ASW Training Target (EMATT) available from Lockheed Martin Corporation. The MK39 EMATT uses lithium sulfur dioxide high energy density batteries for power. The MK39 EMATT is currently deployed from surface ships or aircraft. Submarines do not typically deploy the MK39 EMATT because of risks involved in bringing lithium sulfur dioxide batteries on board a submarine. Instead, submarines typically utilize an ATT referred to as a Submarine Mobile Acoustic Training Target (or SubMATT). SubMATTs use lower energy density alkaline batteries that occupy more volume than a standard EMATT. This increases the length of the SubMATT while reducing the volume for advanced capabilities.

SUMMARY

A canister is described herein that acts as a pressure vessel that contains a payload and that can withstand pressures that may be generated by the payload internal to the canister in order to contain the payload contents. The canister can be used on a vehicle from which the canister can be launched. In some embodiments, the vehicle can be a submarine, with the canister being located internal to the pressure hull of the submarine prior to launch and the canister being launchable from the submarine into the surrounding water. After launching, the canister is designed to release or deploy the payload permitting the payload to perform its intended function(s).

In some embodiments, the payload contained in the canister can be an unmanned underwater vehicle having a propulsion mechanism and a steering mechanism that permits the underwater vehicle to be propelled through the water and steered in desired directions. In some embodiments, the underwater vehicle can be an ATT. In some embodiments, the underwater vehicle can be powered by one or more lithium batteries, for example lithium sulfur dioxide batteries or any other lithium-based batteries.

Methods of containing a payload while onboard a submarine, as well as launching and deploying a payload, such as an unmanned underwater vehicle containing one or more lithium batteries, from a submarine are also described. The payload containing the one or more lithium batteries is held in the pressure vessel canister prior to launch, with the canister designed to be able to withstand the internal pressure generated in the event that one of the lithium batteries fails. The canister can also be launched from the submarine for deployment of the payload or removal of the canister from the interior of the submarine in the event of a failure of the payload prior to launch. In one embodiment, the canister can be launched from the submarine via the submarine's trash disposal unit. However, the canister can be launched from any means on the submarine capable of discharging the canister from the interior of the submarine and into the water.

In one embodiment, a system within the interior of a submarine includes a payload, and a pressure vessel canister defining an interior space, where the payload is contained within the interior space. The payload can be an unmanned underwater vehicle having a propulsion mechanism and a steering mechanism. In some embodiments, the payload can include one or more lithium batteries that power the propulsion mechanism and the steering mechanism. In some embodiments, the unmanned underwater vehicle can be an ATT. The pressure vessel canister can be launchable from the submarine, and once launched, the pressure vessel canister is configured to deploy the unmanned underwater vehicle.

In one embodiment, a method described herein can include storing a payload that includes one or more lithium batteries inside a submarine within an interior space of a pressure vessel canister. The pressure vessel canister is liquid and pressure tight and is capable of withstanding an internal pressure that is larger than ambient pressure of the submarine, the internal pressure generated as a result of venting by failure of at least one of the one or more lithium batteries. The method can also include launching the pressure vessel canister with the payload contained therein from the submarine, for example from a trash disposal unit of the submarine.

DRAWINGS

DETAILED DESCRIPTION

Figure 1:
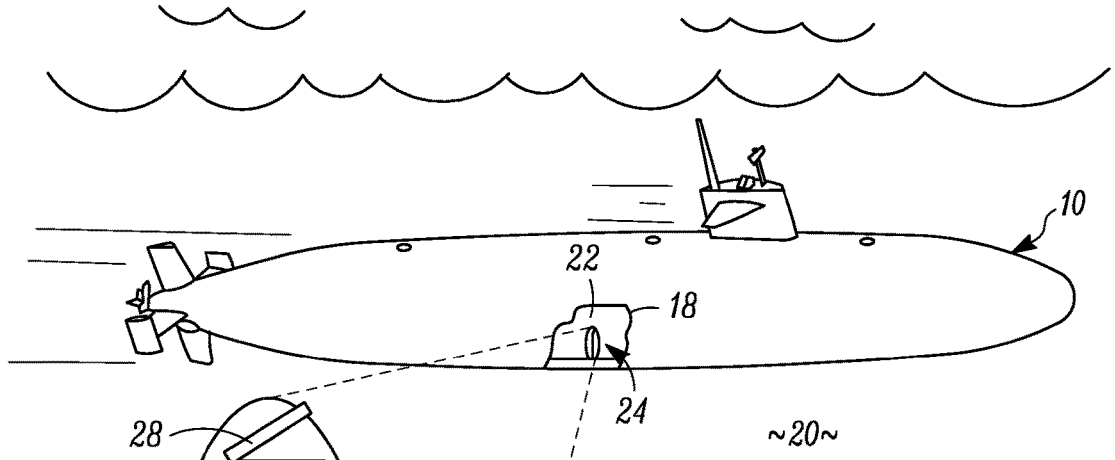
FIG. 1 illustrates a submarine and a trash disposal unit from which the pressure vessel canister described herein can be launched.

FIG. 1 illustrates a submarine 10 within which an assembly 12 of a pressure vessel canister 14 and a payload 16 contained within the canister 14 (best seen in FIG. 3) can be stowed in and transported by, as well as be launched from, the submarine 10. The submarine 10 is of well-known construction and includes a pressure hull 18 that permits the submarine 10 to travel under water 20 at great depths. The pressure hull 18 defines an interior dry space 22 of the submarine 10 that carries personnel, equipment, etc. A trash disposal unit 24 of conventional construction and operation is provided on the submarine 10 and through which trash can be discharged from the interior space 22 of the submarine 10 and into the water 20.

Figure 2:
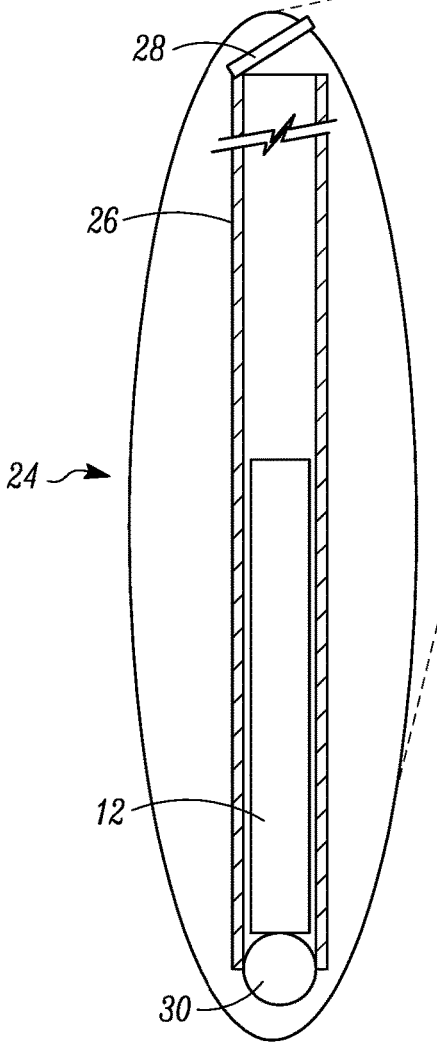
FIG. 2 is a detailed illustration of the trash disposal unit of the submarine.

FIG. 2 shows the trash disposal unit 24 as including a tube 26 having an openable and closeable breech door 28 at a top end of the tube 26, and a valve 30 at the bottom end of the tube 26. The assembly 12 of the pressure vessel canister 14 and the payload 16 is shown loaded into the tube 26 ready for launch from the submarine 10. The assembly 12 is loaded into the top of the tube 26 by opening the breech door 28, inserting the assembly 12, and then closing the breech door 28. Water can then be flooded into the interior of the tube 26 and the valve opened 30 to allow the assembly 12 to launch from the tube 26 by falling from and out of the tube 26 under its own mass. In other embodiments, supplemental pressure can be used to aid in launching the assembly 12 from the tube 26. Further information on the construction and operation of the trash disposal unit 24 can be found in U.S. Pat. No. 5,666,900 the entire contents of which are incorporated herein by reference.

To help explain and understand the positioning of the payload 16 within the canister 14, and to help explain the construction and operation of certain features internal to the canister 14, portions of the canister 14 are illustrated in some of the figures herein as being transparent.

Figure 3:
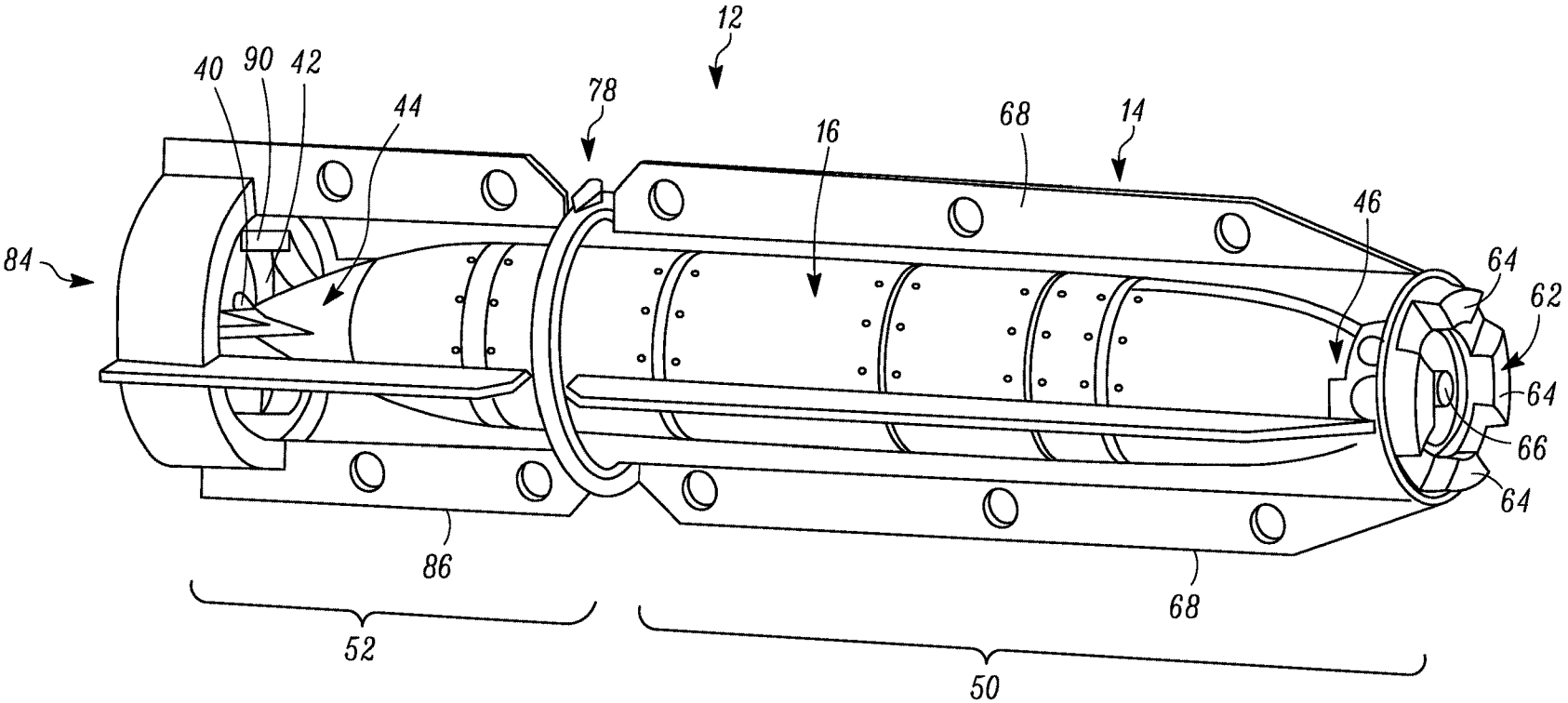
FIG. 3 is a perspective view of an assembly of the pressure vessel canister and the payload contained therein prior to launch, with portions of the pressure vessel canister illustrated as being transparent to show the payload contained therein.
Figure 4:
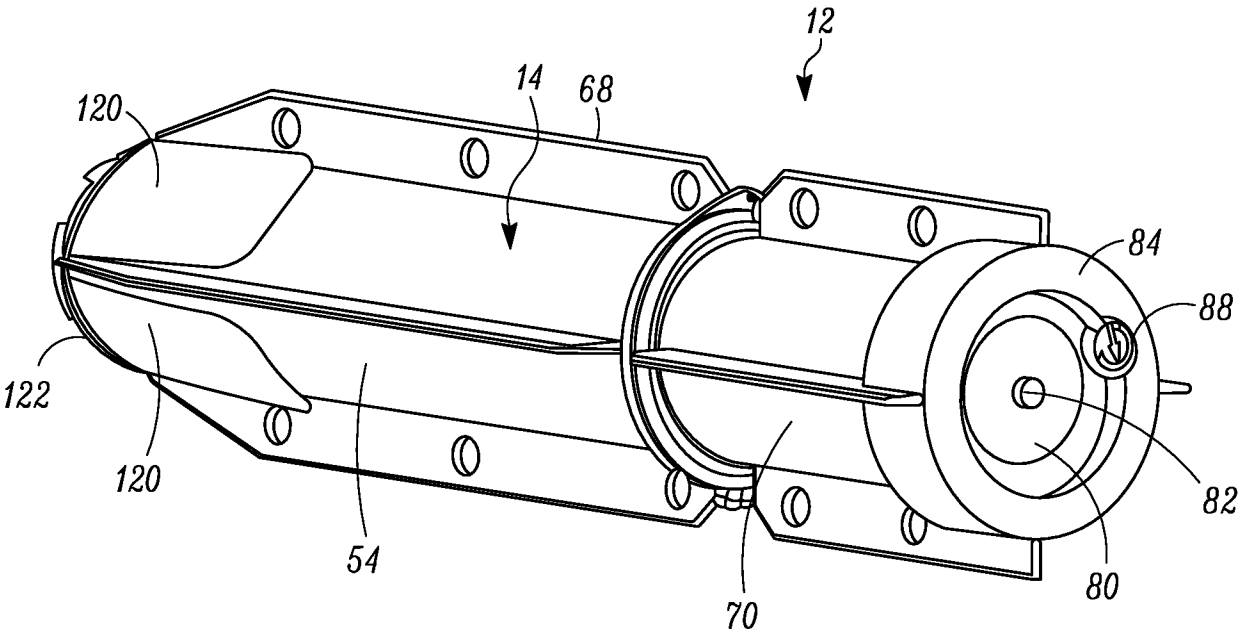
FIG. 4 is a rear perspective view of the assembly of the pressure vessel canister and the payload contained therein prior to launch.
Figure 5:
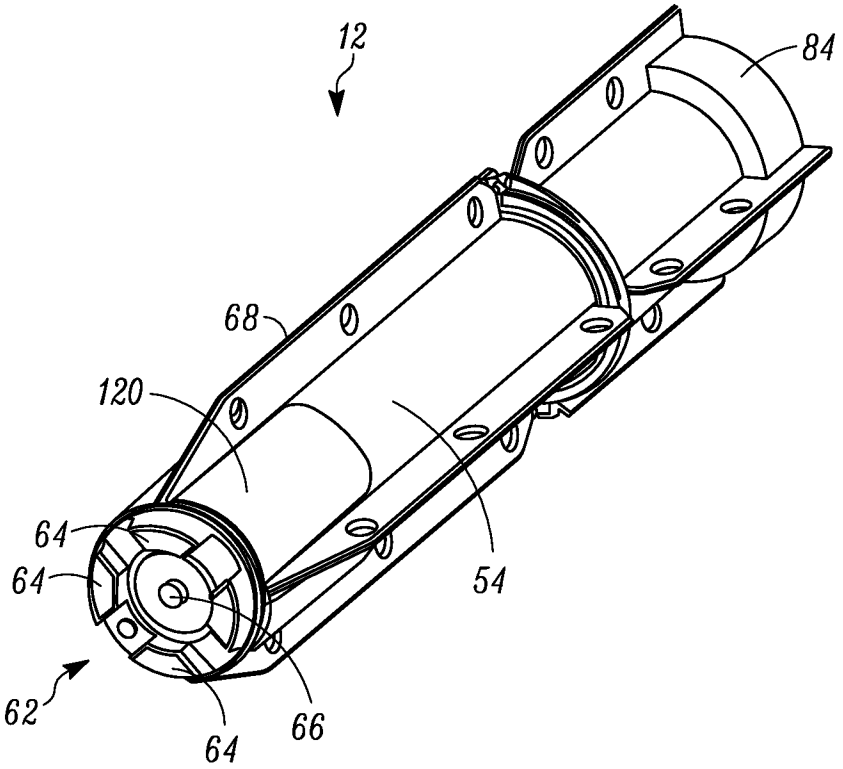
FIG. 5 is a front perspective view of the assembly of the pressure vessel canister and the payload contained therein prior to launch

Referring to FIGS. 3-5, the assembly 12 is illustrated in a storage, transport or pre-launch mode. The canister 14 forms a closed container or pressure vessel that is designed to hold gases or liquids, that may be part of or generated by the payload 16, at a pressure that is substantially larger than the ambient pressure surrounding the canister 14, for example the ambient pressure contained in the interior space 22 of the submarine 10. The payload 16 is completely housed within the pressure vessel canister 14 to shield the payload 16 from the external environment outside the canister 14, and to shield the external environment outside the canister 14 from the payload 16.

The pressure vessel canister 14 prevents potentially hazardous materials from the payload 16 from discharging into the interior space 22 of the submarine 10. The payload 16 can be any device that is configured to perform a mission outside of the submarine 10 after it is launched from the submarine 10. In the embodiment illustrated in FIGS. 3-5, the payload 16 can be an unmanned underwater vehicle having a propulsion mechanism 40, such as a rotating propeller, and a steering mechanism 42, such as steerable control fins, at an aft end 44 thereof that permit the underwater vehicle to be propelled through the water 20 and steered in desired directions after launch and deployment. A forward end 46 of the payload 16 can be bullet-shaped or have another hydrodynamic configuration that facilitates travel of the payload 16 through the water 20 once it is deployed.

In some embodiments, power for powering the underwater vehicle, including the propulsion mechanism 40 and the steering mechanism 42, can be provided by one or more lithium batteries (not shown), including, but not limited to, lithium sulfur dioxide batteries or any lithium-based battery. In some embodiments, the unmanned underwater vehicle can be an ATT such as the MK39 EMATT or the SubMATT. In embodiments where the payload 16 is powered by one or more lithium batteries, a failure in one or more of the lithium batteries can cause venting of harmful gases, such as sulfur dioxide ($SO_2$) in the case of lithium sulfur dioxide batteries, and volatile organics from the payload 16. However, the pressure vessel canister 14 is designed to contain such gases and prevent their spread to the interior space 22 of the submarine 10. In one non-limiting example, the pressure vessel canister 14 can be designed to withstand up to about 330 psi of internal pressure.

Figure 6:
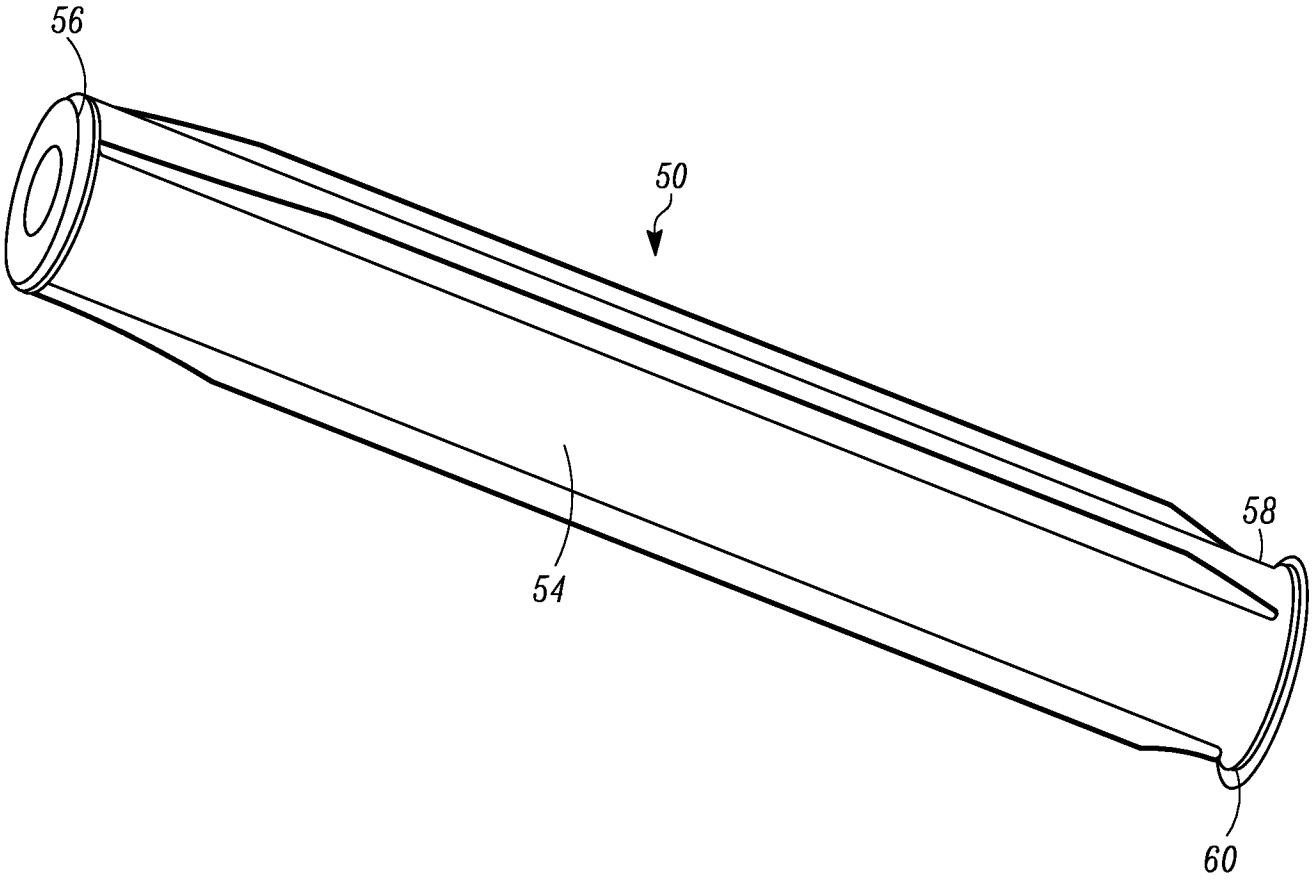
FIG. 6 is a perspective view of the forward hull section of the pressure vessel canister.

Referring to FIG. 6 along with FIGS. 3-5, the pressure vessel canister 14 includes a forward hull section 50 and an aft hull section 52. The forward hull section 50 includes a generally cylindrical housing 54 with a forward end 56 and an aft end 58. The aft end 58 is formed with a radial outward extending flange 60 that is used for securing the forward hull section 50 to the aft hull section 52 as described further below. The housing 54 is generally hollow and defines a space that receives the payload 16 therein. A cap that includes a bumper 62 (FIGS. 3-5 and 10) is fixed to and closes the forward end 56 of the housing 54 in a liquid tight manner. In one embodiment, the bumper 62 can be substantially rigid and can be formed from a polymeric material including, but not limited to, nylon. The bumper 62 is formed with a plurality of stand-offs 64 to protect the trash disposal unit 24 from damage during launch, and a port in the cap is sealingly closed by a removable plug 66. Removal of the plug 66 permits water to flood into the interior of the canister 14 as described below.

A plurality of rails 68 are also provided on the outside of the housing 54. Each rail 68 extends axially along substantially the entire length of the housing 54, and each rail 68 extends substantially radially from the housing 54. The rails 68 help center the assembly 12 within the tube 26 of the trash disposal unit 24, help protect the assembly 12 from damage, and help prevent damage to the trash disposal unit 24.

Figure 8:
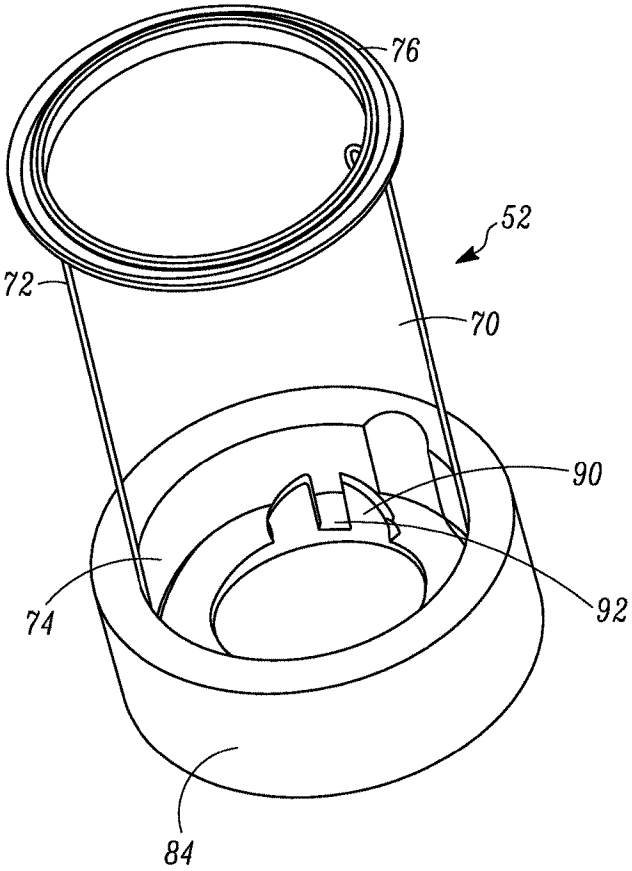
FIG. 8 is a perspective view of the aft hull section of the pressure vessel canister.

With reference to FIG. 8 along with FIGS. 3-5, the aft hull section 52 includes a generally cylindrical housing 70 with a forward end 72 and an aft end 74. The forward end 72 is formed with a radial outward extending flange 76 that abuts against the flange 60 of the forward hull section 50 when the hull sections 50, 52 are secured to one another. A sealed retention ring 78, for example a sealed circumferential clamp, encircles the flanges 60, 76 and clamps the flanges 60, 76 together to detachably secure the hull sections 50, 52 to each other. To help maintain a fluid tight seal between the flanges 60, 76, a sealing gasket (not shown) can be provided between the abutting faces of the flanges 60, 76 to prevent fluid leakage between the flanges 60, 76 when the flanges 60, 76 are clamped together by the sealed retention ring 78.

The housing 70 is generally hollow and defines a space that receives the payload 16 therein. A cap 80 (FIGS. 4 and 7) is fixed to and closes the aft end 74 of the housing 70 in a liquid tight manner. A port in the cap 80 is sealingly closed by a removable plug 82. Removal of the plug 82 permits water to flood into the interior of the canister 14 as described further below.

Figure 14:
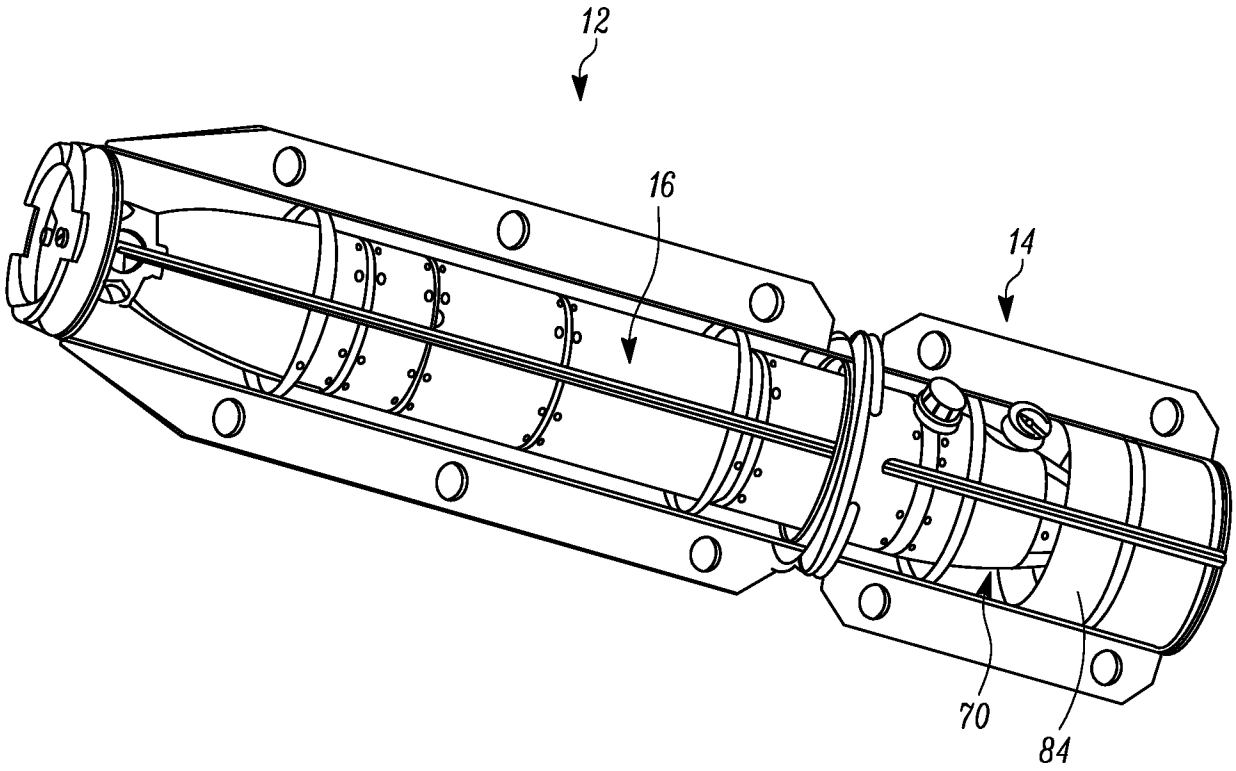
FIG. 14 illustrates an embodiment of the pressure vessel canister and the payload contained therein prior to launch, with portions of the pressure vessel canister illustrated as being transparent to show the payload contained therein, and the aft weight disposed within the pressure vessel canister.

A weight 84 is fixed near the aft end 74 of the housing 70 for increasing the mass of the aft end 74. The weight 84 can take any shape and form, and can be located at any position on or in the aft hull section 52, as long as the weight 84 can perform the function(s) of the weight 84 described herein. In the illustrated example, the weight 84 is shaped as a cylindrical ring that is disposed about the exterior of the housing 70 at the aft end 74. In another embodiment illustrated in FIG. 14, the aft weight 84 is disposed within the housing 70 at the aft end. As described further below, the weight 84 helps create an aft center of gravity to cause the assembly 12 to achieve the correct orientation in the water 20 after launch for properly deploying the payload 16.

A plurality of rails 86 can also be provided on the outside of the housing 70. Each rail 86 extends axially along substantially the entire length of the housing 70, and each rail 86 extends substantially radially from the housing 70. The rails 86 function similarly to the rails 68 in that they help to center the assembly 12 within the tube 26 of the trash disposal unit 24, help protect the assembly 12 from damage, and help prevent damage to the trash disposal unit 24. The rails 86 are not illustrated in FIGS. 8 and 13A-C for sake of convenience. When the canister 14 is assembled, the rails 68 on the forward hull section 50 are aligned with the rails 86 on the aft hull section 52. However, alignment of the rails 68, 86 is not required.

Figure 7:
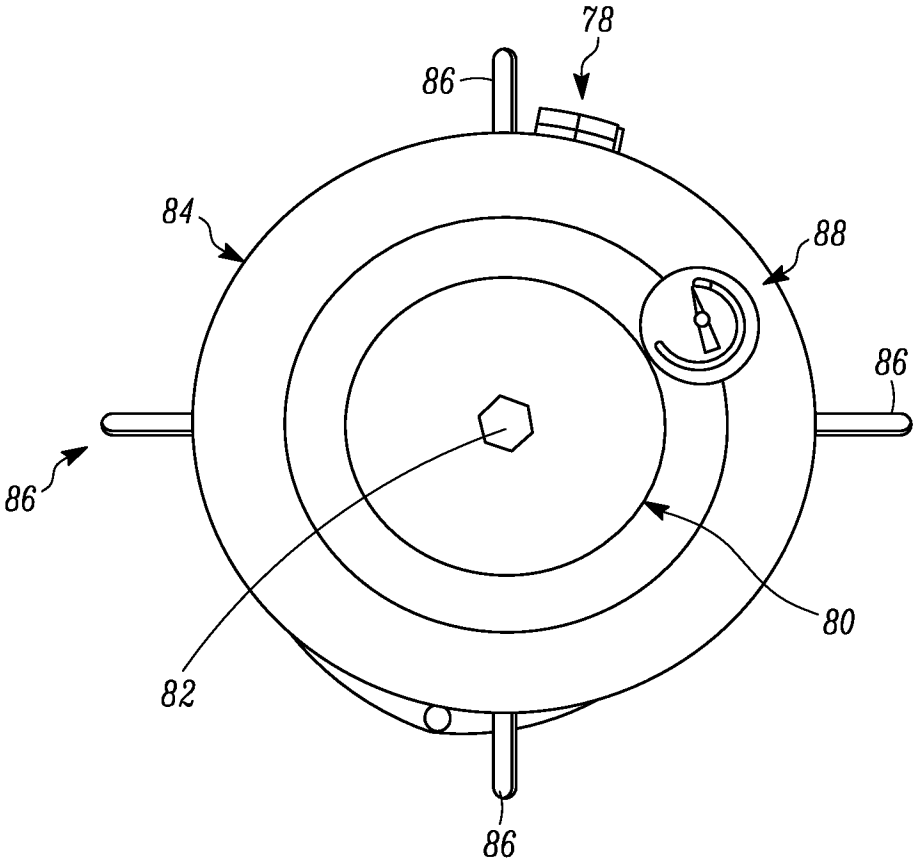
FIG. 7 is an aft end view of the pressure vessel canister prior to launch.

With reference to FIGS. 4 and 7, an exterior pressure gauge 88 is provided for measuring and indicating internal pressure within the interior of the canister 14. The pressure gauge 88 provides a means for personnel to determine whether or not a failure has occurred in the payload 16, for example in one of the lithium batteries, and whether or not it is safe to open the canister 14 for subsequent deployment of the payload 16. The pressure gauge 88 can be provided at any location on the canister 14. In the example illustrated in FIGS. 4 and 7, the pressure gauge 88 is provided on the cap 80 at the aft end 74 of the housing 70 of the aft hull section 52 although other locations are possible.

In some embodiments, the interior of the aft hull section 52 can include an alignment mechanism 90 that interacts with the payload 16 for correctly aligning the payload in the canister 14. For example, with reference to FIGS. 3 and 8, when the payload 16 is an underwater vehicle having steerable control fins, the alignment mechanism 90 can comprise a slot 92 that is defined within the interior of the aft hull section 52 adjacent to the aft end 74. The slot 92 receives one of the control fins of the payload 16 to hold the payload 16 in place so that the payload cannot rotate within the canister 14.

Figure 9:
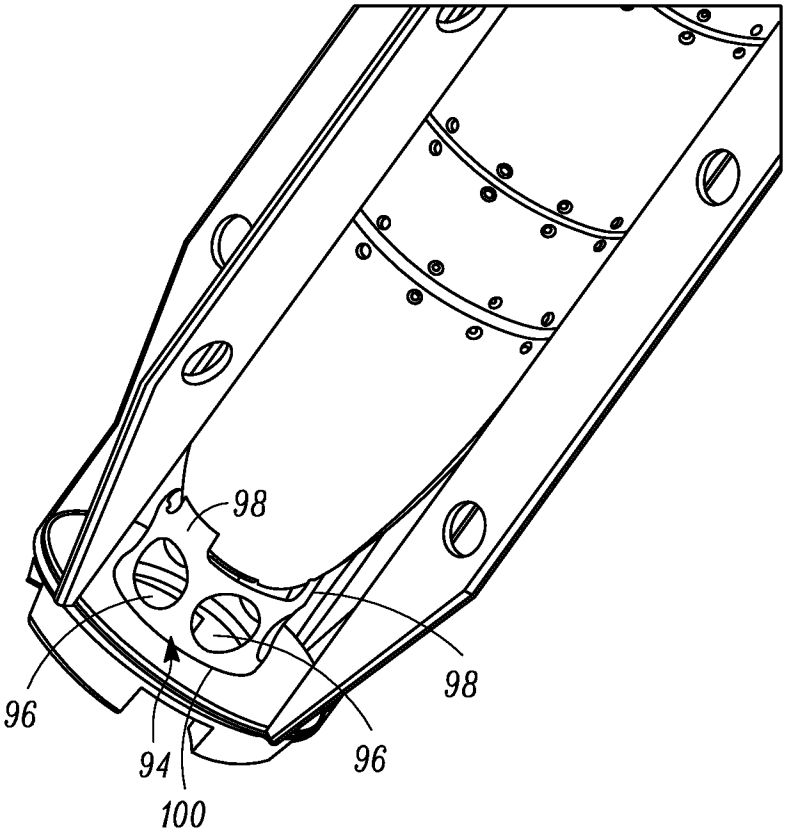
FIG. 9 is a perspective view of the front portion of the assembly showing a stand-off mechanism holding the front end of the payload in place prior to launch.
Figure 10:
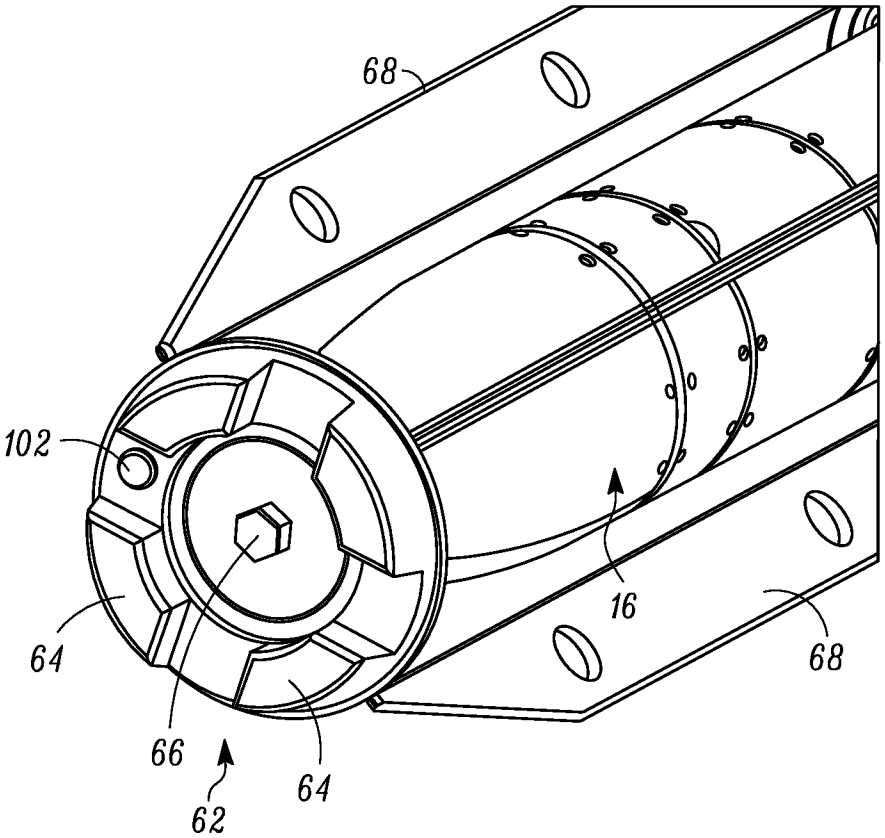
FIG. 10 is another perspective view of the front portion of the assembly showing a removable forward pressure plug prior to launch.

In some embodiments, the interior of the forward hull section 50 can include a stand-off mechanism 94 that holds the front end of the payload 16 in axial position while allowing water to flow past the stand-off mechanism 94 when flooding the canister 14 with water as discussed further below. For example, with reference to FIGS. 3 and 9, the stand-off mechanism 94 can comprise a cylindrical ring with a plurality of circumferentially spaced apertures 96 and circumferentially spaced ribs 98. One end 100 of the stand-off mechanism 94 abuts against the interior surface of the cap of the forward hull section 50, while the opposite end containing the ribs 98 partially receives the forward end 46 of the payload 16.

In some embodiments, a corrosive scuttle plug 102 can be provided in the canister 14. The scuttle plug 102 fills a through hole through some portion of the canister 14, but the scuttle plug 102 is made of a material that corrodes relatively quickly when exposed to water, such as sea water, to permit water to flood into the canister 14. For example, with reference to FIG. 10, the scuttle plug 102 is illustrated as filling a through hole that is formed in the bumper 62. The scuttle plug 102 can be made from magnesium or alloys thereof that are known to react spontaneously and at a controlled rate with sea water. When the scuttle plug 102 corrodes, water can flood into the interior of the canister 14 through the hole previously filled by the scuttle plug 102.

In some embodiments, a manual latching relief valve can be provided on the canister 14 to allow interior pressure in the canister 14 to be relieved manually.

Figure 11A:
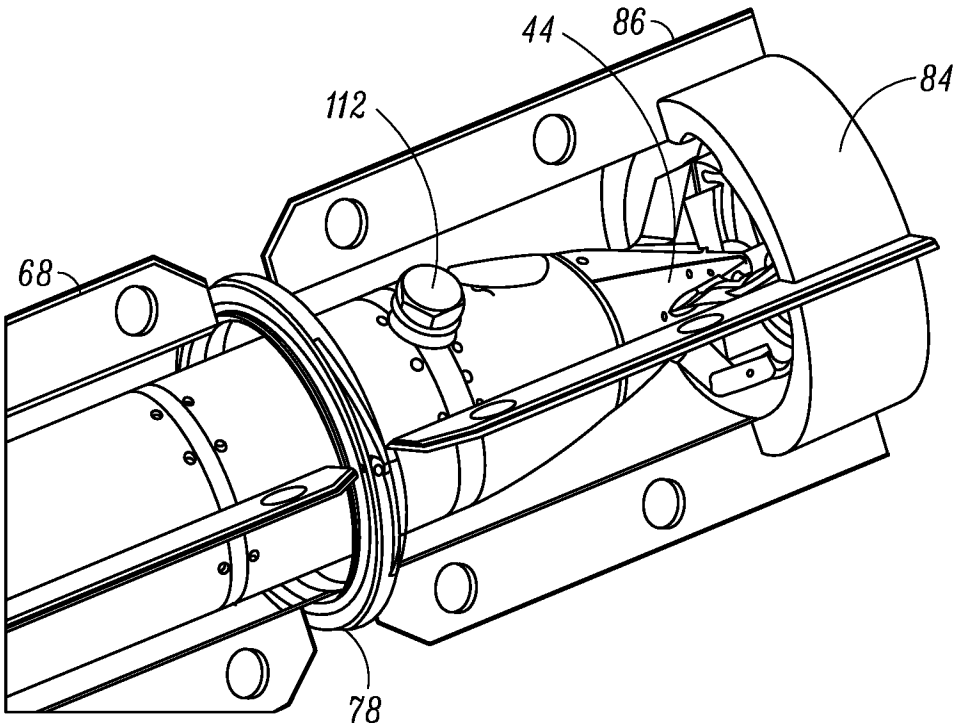
FIGS. 11A and 11B are perspective views of portions of the assembly showing a removable pressure plug providing access to an electrical connector of the payload.
Figure 11B:
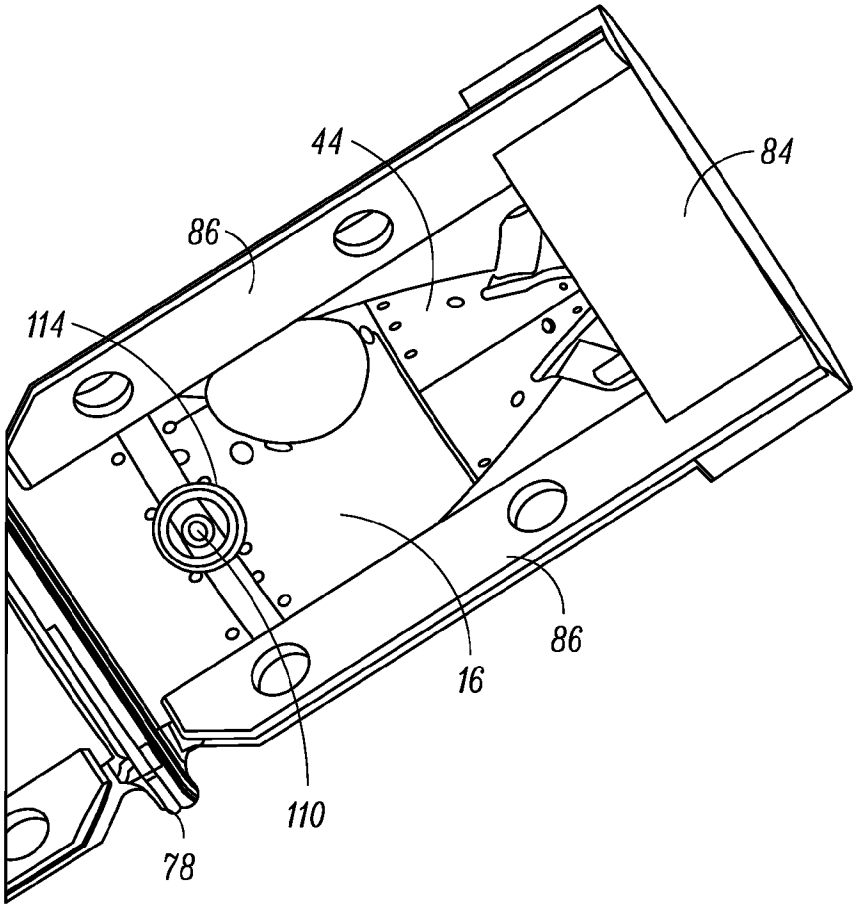

In some embodiments, for example where the payload 16 is programmable, access to the payload 16 can be provided through the canister 14. For example, when the payload 16 is an underwater vehicle that can be programmed, access can be provided through the canister 14 to an electrical connector 110 on the payload 16 through which the payload 16 can be programmed. For example, with reference to FIGS. 11A-B, a removable pressure plug 112 can be provided that fills an access port 114 formed in some portion of the canister 14, for example the housing 70 of the aft hull section 52. The access port 114 is positioned over the electrical connector 110 of the payload 16 such that when the pressure plug 112 is removed from the access port 114 as shown in FIG. 11B, the payload 16 can be programmed by plugging into the electrical connector 110 through the canister 14.

Figure 12:
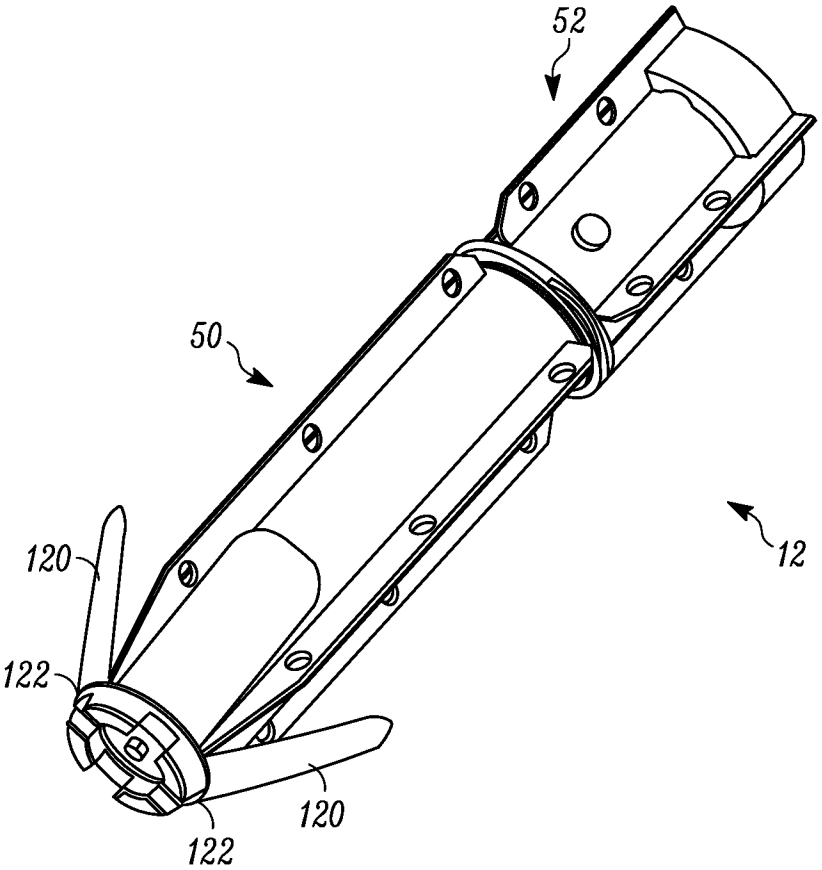
FIG. 12 is a perspective view of the assembly after launch with drag fins on the forward hull section deployed.

In some embodiments, to help the forward hull section 50 separate from the aft hull section 52 after launch, means can be provided for increasing drag on the forward hull section 50 compared to the aft hull section 52. For example, with reference to FIGS. 4-5 and 12, drag fins 120 can be provided on the forward hull section 50. The drag fins 120 can be pivotally attached at leading edges 122 thereof to the housing 54 between the rails 68. The drag fins 120 can pivot from a closed position shown in FIGS. 4 and 5, where the drag fins 120 are substantially flush with the outer surface of the housing 54, to an open position shown in FIG. 12, where the drag fins 120 project outwardly from the forward hull section 50.

In some embodiments, for example where one or more lithium batteries are within the canister 14, a gas absorbent pack can be included within the canister 14 to absorb gases that may be emitted in the event of a failure of one or more of the lithium batteries. In one embodiment, the absorbent pack can be mounted internally in the forward hull section 50 just behind and outside the perimeter of the port containing the removable plug 66.

An example operation of the pressure vessel canister 14 and the payload 16 will now be described. In this example, it will be assumed that the payload 16 is an unmanned underwater vehicle that is powered by one or more lithium batteries. It will also be assumed that the assembly 12 has been loaded into the submarine 10, that the submarine 10 is traveling submerged in the water 20, and that the canister 14 is launched from the trash disposal unit 24 of the submarine 10. However, other variations are possible. The canister 14 is designed to withstand the pressure of multiple ones of the batteries venting as a result of battery failure, for example with up to about a 10× safety factor. In addition, the canister 14 containing the unmanned underwater vehicle and the failing battery(s) can be immediately flushed out of the submarines trash disposal unit 24 in the event of a "severe" battery failure.

For normal operation, the end user would monitor the pressure gauge 88. With the canister 14 in a normal low pressure range, the pressure plug 112 can be removed to access the underwater vehicle and the mission of the underwater vehicles can be programmed. The pressure plug 112 can be replaced if the user is not ready to launch and to maintain safety.

To prepare for launch under normal circumstances, the end plugs 66, 82 (and optionally the pressure plug 112) and the retaining ring 78 of the canister 14 are removed and the canister 14 with the underwater vehicle still encased therein is placed in the trash disposal unit 24. The canister 14 is loaded into the tube 26 of the trash disposal unit 24 with the forward end down and the aft end up. The canister 14 is then launched from the trash disposal unit 24. Because the plugs 66, 82 and the plug 112 have been removed, water that is introduced into the tube 26 of the trash disposal unit 24 during launch can flow into the canister 14. The weight 84 attached to the aft section of the canister 14 pushes the canister 14 out of the trash disposal unit 24 as the sea water flows around and into the canister 14.

Figure 13A:
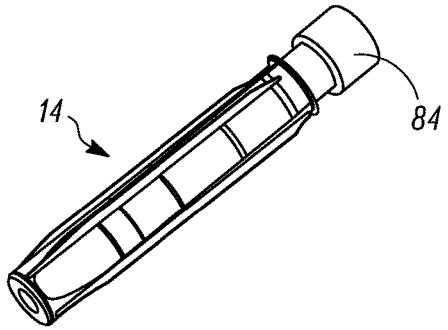
FIGS. 13A, 13B and 13C illustrate a sequence of deployment of the payload from the pressure vessel canister after the assembly has been launched from the submarine.
Figure 13B:
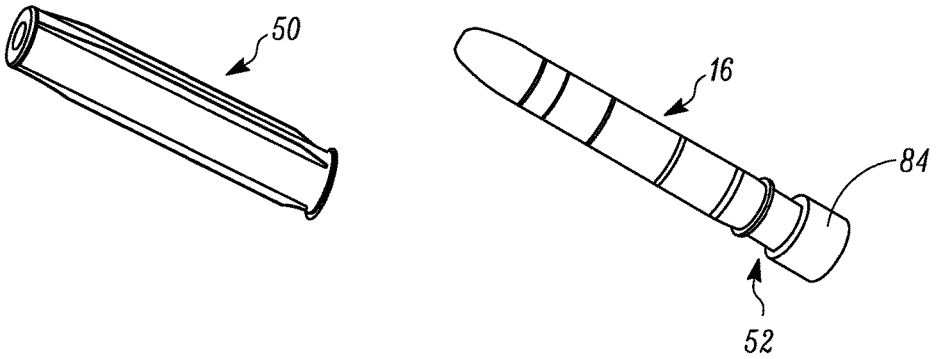
Figure 13C:
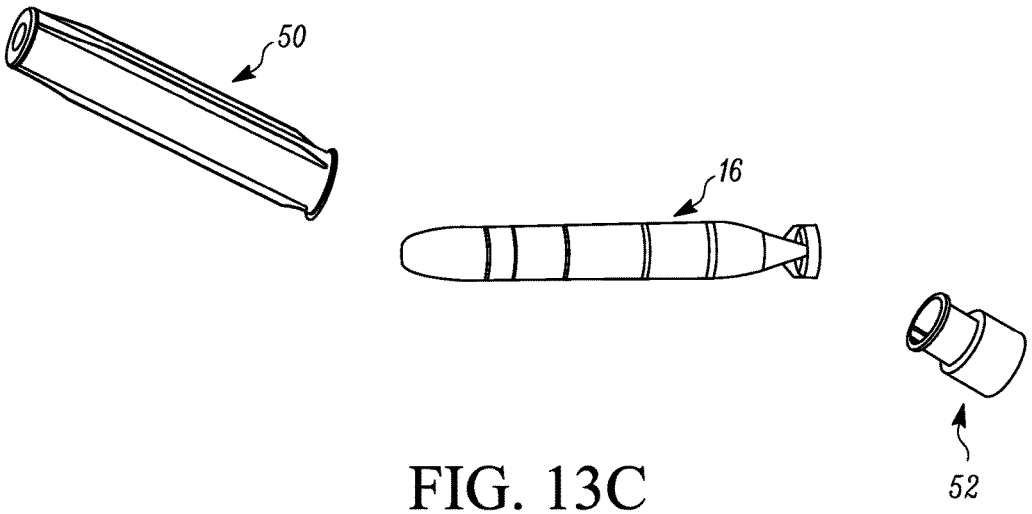

FIG. 13A depicts the canister 14 shortly after exiting the trash disposal unit 24. The canister 14 is oriented with the forward end down and the aft end up. The weight 84 at the aft end creates an aft center of gravity, thereby causing the canister 14 to rotate as shown in FIG. 13B. As the canister 14 rotates, sea water can flow under the drag fins 120, causing the drag fins 120 to automatically open to the position shown in FIG. 12 (the drag fins are not illustrated in FIGS. 13A-C for convenience). The increased drag created by the drag fins 120 helps the forward hull section 50 separate from the aft hull section 52 as shown in FIG. 13B. The aft hull section 52 also falls away from the underwater vehicle whereby the underwater vehicle is now deployed and clear of the hull sections 50, 52 to begin its intended mission.

In the event of an emergency, for example one or more lithium batteries fails as indicated by the pressure gauge 88, the canister 14 may need to be launched from the submarine 10 without subsequent deployment of the underwater vehicle in order to remove the canister 14 from the submarine 10. In such an event, the canister 14 can be loaded into the trash disposal unit 24 with the end plugs 66, 82, the pressure plug 112, and the retaining ring 78 still in place to maintain the pressure integrity of the canister 14. The canister 14 can then be launched from the trash disposal unit 24 into the water 20. The corrosive scuttle plug 102 reacts with the water, ultimately opening its associated through hole to allow water to flood into the canister 14 as the canister 14 sinks to the bottom.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A system within the interior of a submarine, comprising:

a payload that includes one or more lithium batteries, the payload is an unmanned underwater vehicle having a propulsion mechanism and a steering mechanism;

a pressure vessel canister defining an interior space, the payload is contained within the interior space, wherein the pressure vessel canister is liquid and pressure tight and is capable of withstanding an internal pressure that is larger than ambient pressure of the submarine, the internal pressure generated as a result of venting by failure of at least one of the one or more lithium batteries.

2. The system of claim 1, wherein the one or more lithium batteries power the propulsion mechanism and the steering mechanism.

3. The system of claim 1, wherein the unmanned underwater vehicle is an acoustic training target.

4. The system of claim 1, wherein the pressure vessel canister is launchable from the submarine, and once launched, the pressure vessel canister is configured to automatically release the unmanned underwater vehicle.

5. The system of claim 1, wherein the pressure vessel canister includes a forward hull section and an aft hull section that are detachably connected to one another, and a seal between the forward hull section and the aft hull section to prevent fluid leakage between the forward hull section and the after hull section.

6. The system of claim 5, further comprising a first port formed in the forward hull section, the first port is closed by a removable plug; and a second port formed in the aft hull section, the second port is closed by a removable plug.

7. A system within the interior of a submarine, comprising:

a payload that includes one or more lithium batteries;

a pressure vessel canister defining an interior space, the payload is contained within the interior space, wherein the pressure vessel canister is liquid and pressure tight and is capable of withstanding an internal pressure that is larger than ambient pressure of the submarine, the internal pressure generated as a result of venting by failure of at least one of the one or more lithium batteries; and a port formed in the pressure vessel canister and a corrosive scuttle plug that closes the port.

8. A system within the interior of a submarine, comprising:

a payload that includes one or more lithium batteries;

a pressure vessel canister defining an interior space, the payload is contained within the interior space, wherein the pressure vessel canister is liquid and pressure tight and is capable of withstanding an internal pressure that is larger than ambient pressure of the submarine, the internal pressure generated as a result of venting by failure of at least one of the one or more lithium batteries; and the pressure vessel canister includes an exterior pressure gauge that measures and indicates internal pressure within the interior space.

9. A system within the interior of a submarine, comprising:

a payload that includes one or more lithium batteries;

a pressure vessel canister defining an interior space, the payload is contained within the interior space, wherein the pressure vessel canister is liquid and pressure tight and is capable of withstanding an internal pressure that is larger than ambient pressure of the submarine, the internal pressure generated as a result of venting by failure of at least one of the one or more lithium batteries; and a non-metallic bumper at a forward end of the pressure vessel canister.

10. A system within the interior of a submarine, comprising:

a payload that includes one or more lithium batteries;

a pressure vessel canister defining an interior space, the payload is contained within the interior space, wherein the pressure vessel canister is liquid and pressure tight and is capable of withstanding an internal pressure that is larger than ambient pressure of the submarine, the internal pressure generated as a result of venting by failure of at least one of the one or more lithium batteries; and rails disposed on an exterior surface of the pressure vessel canister, the rails are circumferentially spaced from one another, the rails project radially from the exterior surface, and the rails extend the majority of a length of the pressure vessel canister.

11. The system of claim 1, further comprising an access port formed in the pressure vessel canister that is positioned over an electrical connector of the unmanned underwater vehicle, and the access port is closed by a removable plug.

12. The system of claim 5, further comprising drag fins attached to a forward end of the forward hull section.

13. A method comprising:

storing a payload that includes one or more lithium batteries inside a submarine within an interior space of a pressure vessel canister, the pressure vessel canister is liquid and pressure tight and is capable of withstanding an internal pressure that is larger than ambient pressure of the submarine, the internal pressure generated as a result of venting by failure of at least one of the one or more lithium batteries; and launching the pressure vessel canister with the payload contained therein from the submarine.

14. A method comprising:

storing a payload that includes one or more lithium batteries inside a submarine within an interior space of a pressure vessel canister, the pressure vessel canister is liquid and pressure tight and is capable of withstanding an internal pressure that is larger than ambient pressure of the submarine, the internal pressure generated as a result of venting by failure of at least one of the one or more lithium batteries; and launching the pressure vessel canister with the payload contained therein from a trash disposal unit of the submarine.

15. A method comprising:

storing a payload that includes one or more lithium batteries inside a submarine within an interior space of a pressure vessel canister, the pressure vessel canister is liquid and pressure tight and is capable of withstanding an internal pressure that is larger than ambient pressure of the submarine, the internal pressure generated as a result of venting by failure of at least one of the one or more lithium batteries, wherein the payload is an unmanned underwater vehicle having a propulsion mechanism and a steering mechanism.

16. The method of claim 15, further comprising designing the pressure vessel canister so that the pressure vessel canister separates into pieces after being launched from the submarine in order to release the payload.

* * * * *